US005081932A

United States Patent [19]

Hofmann

[11] Patent Number: 5,081,932

[45] Date of Patent: Jan. 21, 1992

[54] AERIAL TRAMWAY INSTALLATION

[75] Inventor: Gottfried Hofmann, Kiesen, Switzerland

[73] Assignee: Von Roll Transportsysteme AG, Thun, Switzerland

[21] Appl. No.: 526,014

[22] Filed: May 21, 1990

[30] Foreign Application Priority Data

May 23, 1989 [CH] Switzerland ..... 01937/89

[51] Int. Cl.[5] ..... B61B 12/00

[52] U.S. Cl. ..... 104/112; 104/173.1; 104/116

[58] Field of Search ..... 104/112, 117.1, 115, 104/116, 173.1, 173.2, 180, 182, 183, 122; 105/149.1, 149.2; 414/348, 345, 347, 540

[56] References Cited

U.S. PATENT DOCUMENTS 4,509,430 4/1985 Creissels ..... 104/112

FOREIGN PATENT DOCUMENTS 0265354 4/1988 European Pat. Off. ..... 104/173.1
0526484 5/1931 Fed. Rep. of Germany ..... 104/112
0172170 8/1952 Fed. Rep. of Germany ... 105/149.1
127677 9/1928 Switzerland .
309084 10/1955 Switzerland .

OTHER PUBLICATIONS

Internationale Seilbahnrundschar 2/1976, pp. 59-61.
Schweizerisches Baublatt No. 92, 11/1987, pp. 34, 36, 38.

*Primary Examiner*—Douglas C. Butler
*Assistant Examiner*—Mark T. Le
*Attorney, Agent, or Firm*—Cushman, Darby & Cushman

[57] ABSTRACT

An aerial tramway installation has two spaced apart terminals with a transport track interconnecting the terminals. A rescue track extends along the transport track and is elevated with respect thereto. Transport cars having transport cabins are movable along the transport track and a rescue car having a rescue cabin is movable along the rescue track. A rescue vessel can be lowered and lifted between the rescue cabin and a transport car on the transport track. The passenger capacity of the transport cabin and of the rescue cabin are substantially equal, whereas the rescue vessel is supported outside of the rescue cabin and is able to transport two persons at each lifting operation.

17 Claims, 3 Drawing Sheets

AERIAL TRAMWAY INSTALLATION

BACKGROUND OF THE INVENTION

1. Field of the Invention

This invention relates to an aerial tramway or aerial cable transport installation having a tramway system including transport carriers or cars moving between terminals or stations on at least one transport track or path and having an emergency or rescue system including a rescue car moving on a separate track parallel to the transport track in order to assist or rescue passengers of the transport cars in case of these latter becoming stranded anywhere along the track.

2. Description of the Prior Art

The prior art contains aerial tramways where a rescue car movable on an independent rescue track is provided. Among these prior art tramways there are several examples of this rescue track being provided in between parallel transport tracks such as in the installation disclosed for instance in Swiss Patent 309 084. The rescue car supported by its own rescue track cables independent of those of the transport tramway may be moved along the latter to any desired location or site between the stations thereof. However, in order to permit a rescue operation to be carried out at transport cars stranded on either one of the transport tracks, the tension of the track cables needs to be altered in order to influence the cable sag, to thereby raise or lower the cabin of the rescue car on a level approximating that of the cabin of the transport car in question.

SUMMARY OF THE INVENTION

An object of the invention is the provision of an aerial tramway installation which permits to quickly and safely rescue passengers in stranded transport cars without the need for complicated car or cabin adjustment operations.

A further object of the invention is to provide an aerial tramway installation permitting a safe transfer of passengers to be rescued from a stranded transport car to a secure location.

An other object of the invention is the provision of a rescue system having a rescue track for a rescue car adjacent to and coextensive with the transport track or tracks of a tramway system and independent thereof where, due to the arrangement of the cables or ropes of such rescue track above the cables or ropes of the transport tracks, a danger of one system interfering with the other, for instance under the influence of wind forces acting theron, is safely avoided despite the desired proximity of these tracks.

A further object of the invention is to provide an aerial tramway installation where a rescue car movable on an independent rescue track running along a transport track and elevated with respect to the transport carriers or cars thereon carries a rescue vessel capable of being lowered down to a stranded one of said transport carriers and to be lifted up to the rescue car to permit safe transfer of the passengers from such stranded carrier. A still further object of the invention is to provide an aerial tramway installation in which a rescue track coextensive with a pair of transport tracks is arranged intermediate but above the latter and permits a rescue vessel to reach any desired location on said transport tracks and to carry out a rescue operation at any one of the transport carriers stranded thereon by lowering and lifting a rescue vessel carried by such rescue car.

A further object of the invention is the provision of a rescue system for an aerial tramway which permits the installing thereof subsequent to the erection of the tramway so as to permit the addition of an important safety feature to an existing tramway.

The various features of novelty which characterize the invention are pointed out with particularity in the claims annexed to and forming a part of this disclosure. For a better understanding of the invention, its operating advantages an specific objects attained by its use, reference should be had to the drawings and descriptive matter in which there is illustrated and described a preferred embodiment of the inventive aerial tramway installation.

BRIEF DESCRIPTION OF THE DRAWING

The invention will be described with reference to the figures of the accompanying drawings, wherein.

DESCRIPTION OF THE PREFERRED EMBODIMENT

In describing the invention reference is made to a line or cable tower for ease of understanding of a required relationship between different tracks of the aerial tramway installation in space in accordance with the invention. However, it should be understood that such relationship is generally present along the tracks between the terminals or stations of the tramway installation and further that, while in a given installation in accordance with the invention there may be one or several towers provided as required, others may require no tower at all, since a single span between terminals is possible and the desired relationship may be obtained without the aid of towers.

Figure 1:
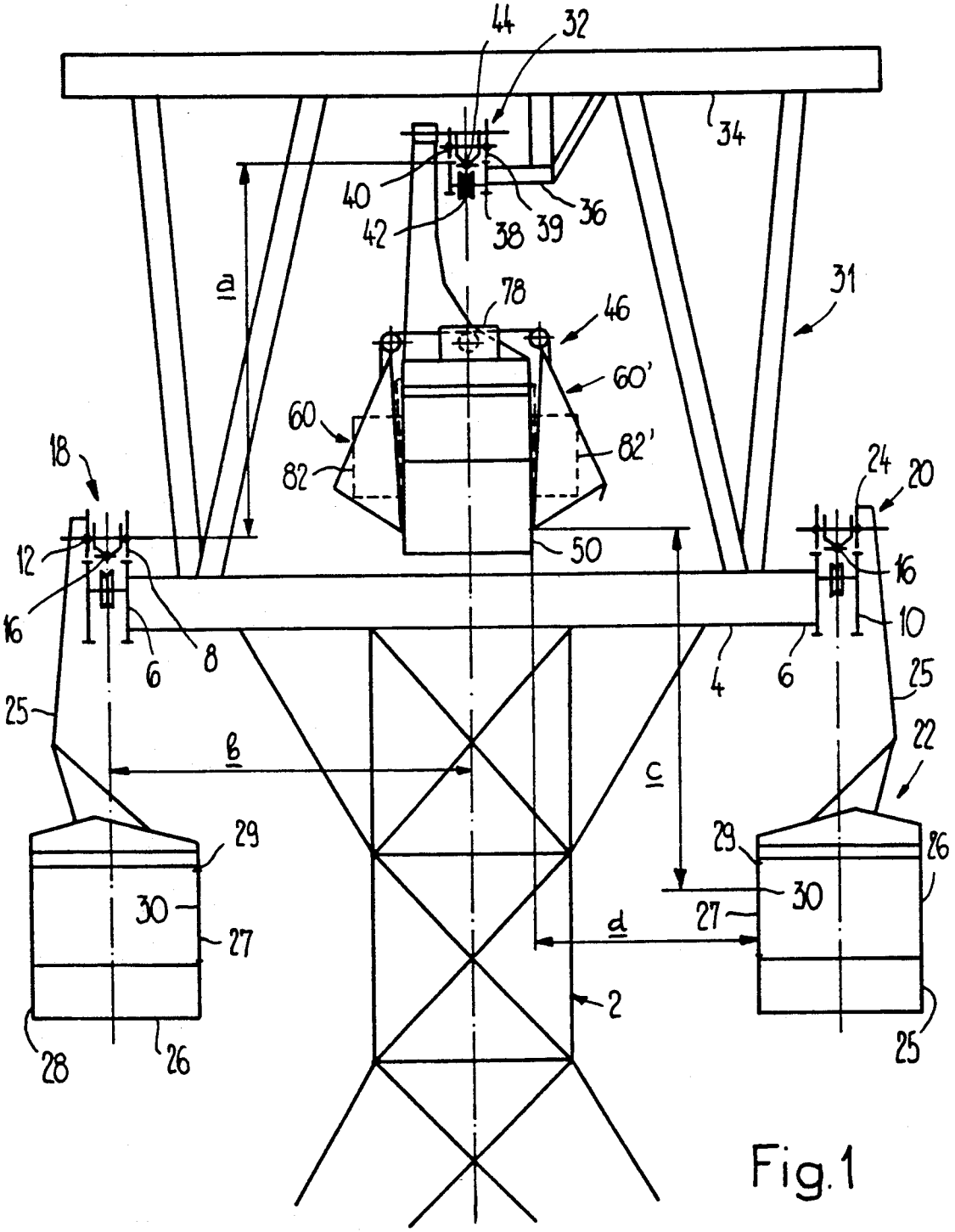
FIG. 1 is a schematic representation of the line and car locations relative to a line tower of the aerial tramway installation according to the invention.

In the drawing the aerial tramway installation in accordance with the invention is shown by way of an example as including a tramway of the gondola lift type having extending between a bottom station and a top station (both not shown) pairs of transport track or support cables 12 and a common transport haulage or traction cable 16. In FIG. 1 reference numeral 2 identifies generally a cable tower positioned intermediate the stations. Only the uppermost portion of the tower 2 is shown, while the lower end is anchored at a foundation in the ground in a manner well known. The tower 2 includes a cross beam 4 which at both of its ends 4*a* carries two supports 6 each having attached thereto a cable shoe 8. Over each of the cable shoes 8 one of the track cables 12 extends and is supported thereby. The traction cable 16 is arranged to run between each pair of track cables 12 and is normally guided by a sheave or cable guide roll 10 arranged intermediate the corresponding cable shoes of the pylon 2. Sheave 10 should be considered as representative for a series of such sheaves arranged in succession and defining a suitably curved path for the traction cable 16 over the tower 2.

The pairs of track cables 12 are part of a transport track or line each, generally identified at 18 and 20, respectively. Transport line 18 is interconnected with transport line 20 at both stations in a manner well known and allows transport vehicles or cars 22 to be moved from one line to the other and coupled with the traction cable 16 to permit a circulatory mode of operation. Each car 22 includes a carriage 24 running on the track cables 12 of a corresponding transport line 18, 20, a gondola or passenger cabin 26 and a suspension structure 25 interconnecting the cabin with the carriage of the car. The cabin 26 has lengthwise extending side walls 27 and 28. For the purposes of the following it is assumed that the cars 22 move up from the bottom station to the top station on transport line 18 and down on transport line 20. Normal access to the cabin 26 is had via a door (not shown) in the outer side wall 28 facing away from tower 2. In inner side wall 27 facing toward such tower a rescue door or opening 29 is provided and normally closed by a door element 30 locked in place, which may be unlocked from outside of side wall 27 and moved away from opening 29. Door element 30 may constitute a wall or window portion of the inner side wall 27.

In accordance with the invention the installation includes a rescue tramway system. Tower 2 as well as all other towers between the bottom and top station of the installation carries a rescue structure generally identified at 31. This structure 31, which has the form of a yoke, is connected to cross beam 4. A rescue track or line 32 extending along lines 18, 20 is arranged substantially midway between the transport lines 18 and 20, and upwardly spaced therefrom. The rescue line 32 is made up of elements corresponding to those of the transport lines 18 and 20. An L-shaped support 36 is mounted to a beam 34 of structure 31 extending parallel to cross beam 4. A pair of transversely spaced carriers 38 is mounted to support 36 and at each of the carriers a cable shoe 39 is attached. A rescue support cable 40 each is supported at the cable shoes 39. Equally a sheave or guide roll 42, arranged between the carriers 38, supports a rescue traction cable 44. One end of traction cable 44 is connected with a rescue car generally indicated at 46 while the other end is connected to a winch mechanism arranged in the top station so as to be able to move rescue car 46 along rescue line 32 by paying out or drawing in cable from such winch. It will be understood that such winch could be arranged at the bottom station instead, provided cable 44 were sufficiently long so as to be run about a sheave provided at the top station. As an alternative manner of moving the rescue car, an endless traction cable comparable to cable 16 and extending between sheaves in the stations could be provided and car 46 connected to it, such as by means of one or more rigid or actuable clamps. In any event, the winch or driven sheave is connected to a prime mover and such prime mover, equally not shown, is independent of the prime mover provided for traction cable 16.

In FIG. 1 transport cars 22 and rescue car 46 are depicted as located in the plane of the cable tower 2. However, it should be understood that such representation is primarily for the sake of completeness of the disclosure in connection with the relationship of the respective transport and rescue tracks 18, 20 and 32 and the cars supported thereon. Rescue track 32 is elevated with respect to transport tracks 18 and 20 by a vertical distance a and transport tracks 18 and 20 are horizontally outwardly spaced with respect to rescue track 32 by a distance b. Consequently, a vertical gap schematically indicated at c and a horizontal gap, schematically indicated at d, exists between cabins 26 and transport cars 22 and cabin 50 of rescue car 46.

Figure 2:
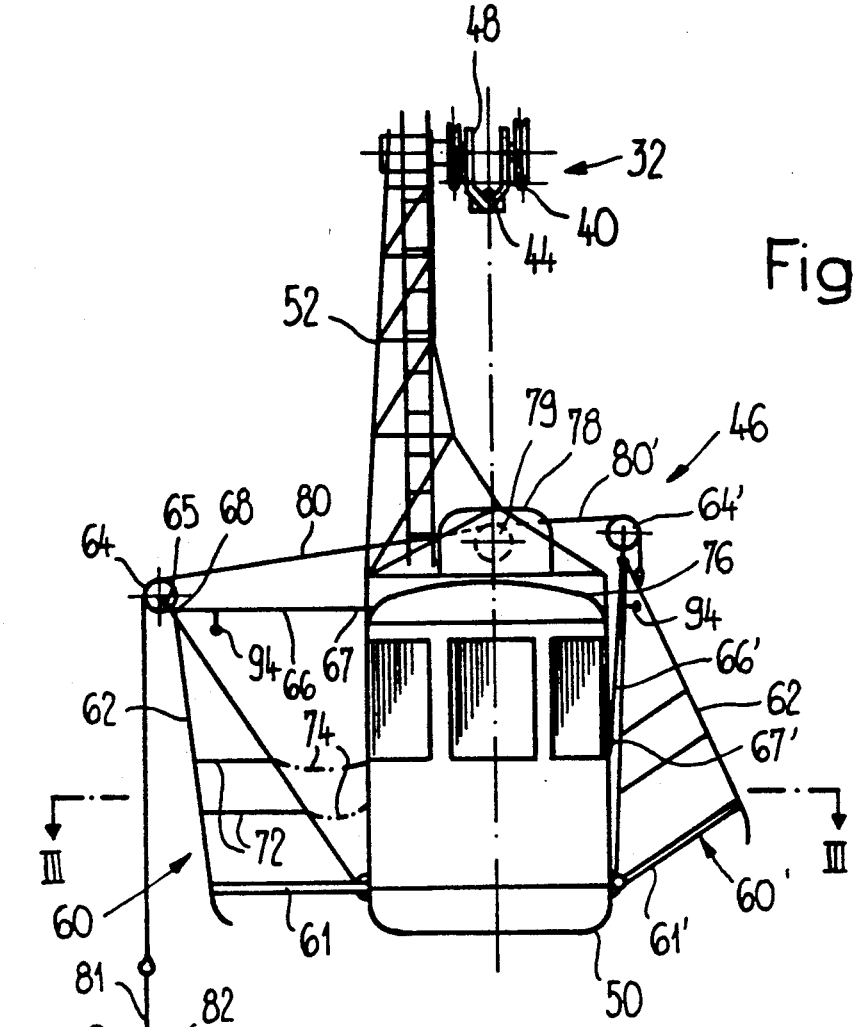
FIG. 2 is a front view of the rescue car according to FIG. 1 on a larger scale together with a rescue vessel in lowered position.

As more clearly shown in FIG. 2, the rescue car 46 includes a carriage 48 supported on the pair of spaced support cables 40 and a cabin 50 connected to the running gear by means of a suspension structure 52 in a manner well known. It should be noted that the passenger capacity of the rescue car, i.e. of its cabin, is larger than that of a single transport cabin and permits to take up at least an additional person who may be a member of a rescue team. In the embodiment shown, each of the cabins 26 takes twenty-five passengers and no space is provided for attendants or other personnel.

Figure 3:
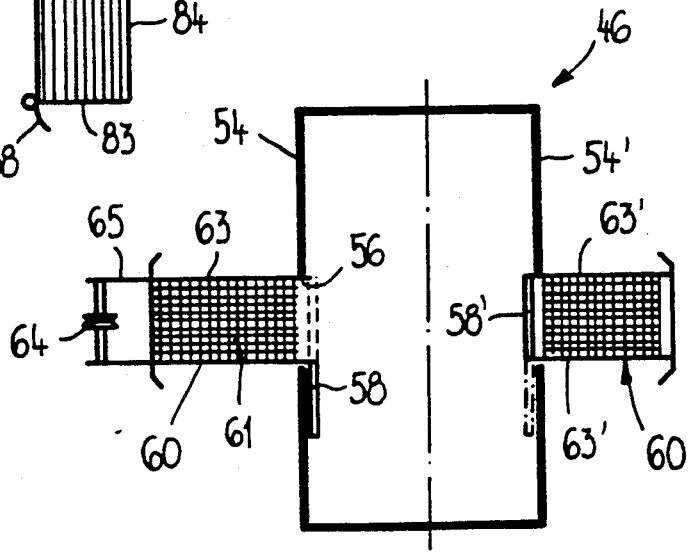
FIG. 3 is a horizontal sectional view through the rescue car taken along line III—III in FIG. 2.

As will be seen from FIG. 3, rescue cabin 50 is rectangular in plan view and has door means including a door opening 56, 56' in each longitudinal side wall 54, 54'. A closure element or sliding door 58, 58' is provided for closing each of the door openings 56, 56', of which door 58 is shown in open position and door 58' in closed position.

A rescue unit 60, 60' is associated with each longitudinal side wall 54, 54' and includes means to transfer passengers between a cabin of a transport car stranded on one of the tracks and the rescue cabin 50 despite vertical gap c and horizontal gap d. Rescue unit 60 and includes a platform or rescue stand 61, 61' in front of each door opening 56, 56'. Platforms 61, 61' are pivotably secured to the respective side walls 54, 54' and may take up a substantially horizontal rescue position, as depicted for platform 61 and an upwardly inclined transport position, as depicted for platform 61'. Both longitudinal sides 63 of each platform have a triangular support element 62 rigidly connected thereto and a pulley 64 is rotatably held at the upper ends 65 of the corresponding support elements. The rescue positions of platform 61, support element 62 and pulley 64 are determined by a frame type link element 66 connected to both support elements 62 of the platform by way of a hinge indicated at 68 and attached to the corresponding side wall 54, 54' at its inner end 67 to permit vertical sliding and pivotal movement thereof. It will be noted that in the horizontal position of platform 61 link element 66 equally takes up a position substantially parallel thereto, whereas in the upwardly inclined position shown for platform 61' link element 66' has its inner end 67' in its lowermost sliding position. This movement permits the support elements 62' to take up a retracted or inwardly inclined position as shown. The support elements 62 are provided with rigid guard rail elements 72 arranged at hip level with respect to their distance above platform 61 and flexible guard rail elements in the form of chains or ropes 74 interconnecting the support elements 62 with the side wall 54. Corresponding guard rail elements are provided for platform 61'. Furthermore it should be noted that link elements 66, 66' are provided with connecting bars 94 for a purpose described hereafter.

Rescue unit 60 also includes a winch means 78 supported at the suspension structure 52 is arranged above the roof 76 of the rescue cabin 50 including one winch 79 each for both of the transport tracks 18 and 20. In addition, winch means 78 includes a prime mover (not shown) for each of the winches 79. Alternatively, the winches 79 may include coupling means for driving engagement with a common prime mover of winch means 78. In the case of a common prime mover, hydrostatic transmission means may be employed for interconnection thereof with the winches. In addition to independent operation of the winches speed control by the transmission means may thus be obtained. A rope 80, 80' of corresponding winch 79 extends over pulley 64, 64' and is connected to a rescue vessel or cage 82, 82' (only vessel 82 shown in FIG. 2) to lower or lift the latter. Rescue vessel 82 has a rectangular bottom 83, walls 84 on all for sides and an open top 85 and in the embodiment shown provides space for two persons in standing position. An bracket 81 secured to the vessel 82 and arranged above the open top 85 is connected to rope 80. Vessel 82 is equipped with a hook or attachment member 86 as well as a fend-off member 88 and the purpose of these members will be explained hereafter. Control means (not shown) for the winch means 78 and/or the winches 79, 79' are placed near the door openings 54, 54' so as to permit a rescue team member to supervise and assist in the transfer of passengers while being able to operate the respective winch from the same position.

OPERATION

Figure 4:
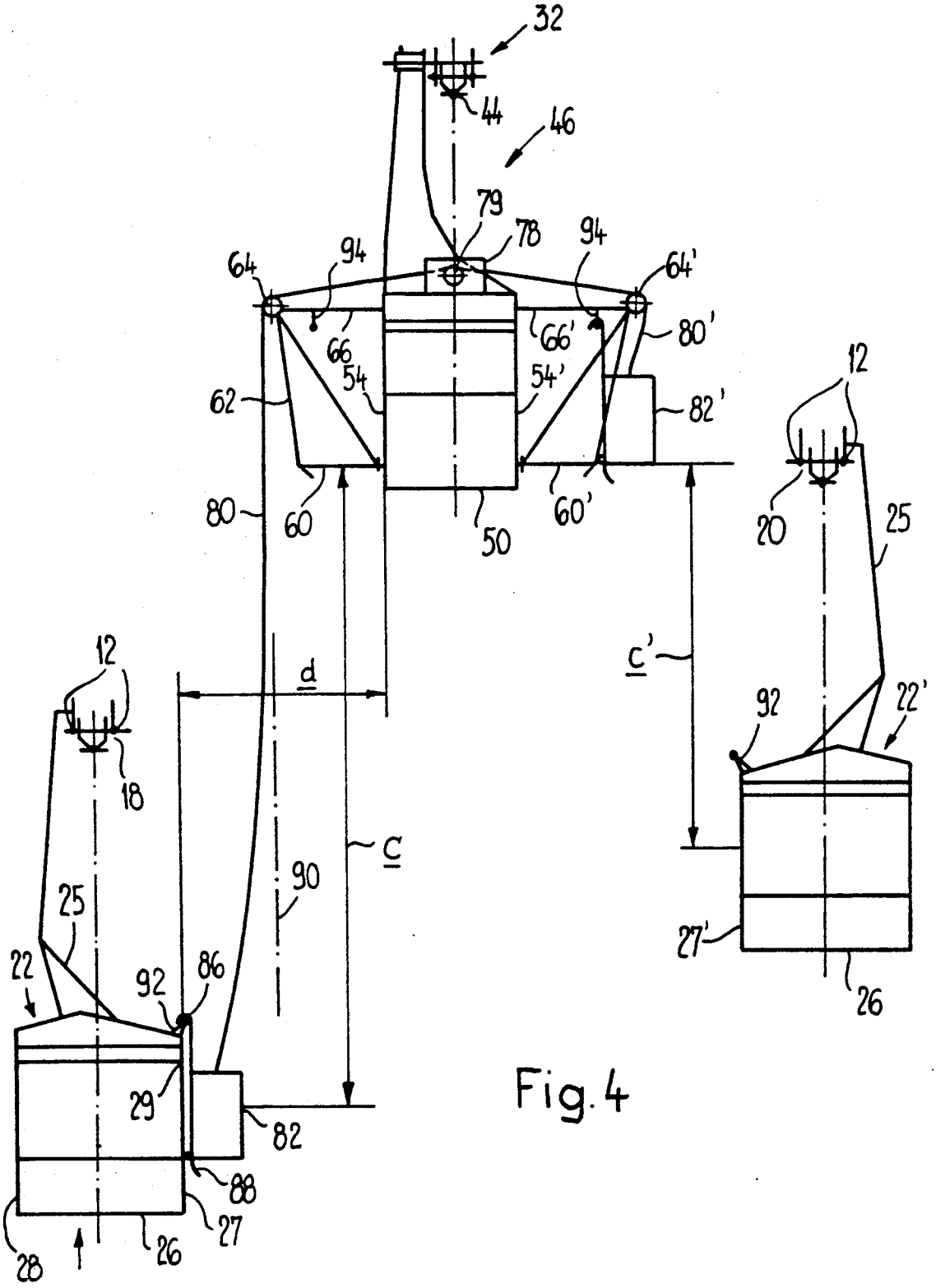
FIG. 4 is a front view of two transport cars and of a rescue car in a rescue situation, shown schematically.

A rescue operation for passengers of two transport cars 22, 22' stranded within a common span of the tracks 18 and 20 will now be described in connection with FIG. 4. For the sake of simplicity of description it is assumed that these cars have become stranded at the same site, i.e. identical points of their tracks. However, it will be noted that due to different sag of their track cables 12, 12', caused by different loads thereon, the respective cars 22 and 22' take up different elevational positions relative to each other in that vertical distance c of transport car 22 is greater than vertical distance c' of transport car 22' with respect to rescue car 50. Further, the horizontal gap d referred to above will be seen to exist between inner side wall 27 of passenger cabin 26 the respective opposed side wall 54 of rescue cabin 50 and moreover a vertical path or axis 90 may pass between such opposed side walls. As will be clear the location of axis 90 is determined by the location of pulley 64, 64' forming rescue vessel guiding means via rope 80, 80'. In connection with the representation in FIG. 4 it is further assumed that the rescue car 46 containing two members of a rescue team was transported on rescue track 32 to the rescue location of the stranded cars 22, 22'. Thanks to a separate rescue track and an independent prime mover for haulage rope 44 or the winch thereof, this is possible even if stranding of transport cars is due to a breakdown of the prime mover for the transport tramway or the transmission thereof and despite a number of transport cars being located intermediate the station and the rescue site. Steps have already been taken to prepare rescue units 60, 60' for a rescue operation in that platforms 61, 61', links 66, 66' and pulleys 64, 64' have taken up the rescue position. Rescue vessel 82' is still about level with rescue cabin 50 in an upper transfer position. This may equally be the position in which such vessel will be transported to the rescue site under conditions allowing the parts of rescue unit to take up or remain in the rescue position as will be explained further down.

Rescue vessel 82 is shown as lowered to the level of cabin 26 by means of winch 79 controlling rope 80 and drawn out of axis 90 against sidewall 27, i.e. in a lower transfer position secured to such cabin. In reaching this position fend-off member 88 may have helped vessel 82 to pass a connecting bar 92 fastened to the roof of cabin 26 if wind forces intervene. It will be noted that in this lower transfer position hook member 86 engages a connecting bar 92 and is held in engagement therewith under its weight. The corresponding door element 30 was previously unlocked and removed from door opening 29 by a rescue team member having descended in rescue vessel 82. Passengers may now transfer from cabin 26 into rescue vessel 82, if necessary with the assistance of a rescue team member. Whenever two passengers have reached the rescue vessel, the latter may be elevated to the level of platform 61 with the aid of winch 79. Winch 79 is operated by another rescue team member normally stationed on platform 61 near door opening 56 and otherwise responsible for upper transfer position 79. It will be noted that by tensioning of rope 80 when actuating winch 79 in a direction to elevate rescue vessel 82, hook member 86 automatically liberates connecting bar 92. Alternatively or additionally, a flexible securing means provided with a carabine hook could be provided to actively prevent inadvertent disengagement of vessel 82 from passenger cabin 26.

From the foregoing it will become clear that for the transfer of passengers from rescue vessel 82 to the rescue cabin 50 the former will be in the relative position represented for vessel 82', i.e. the upper transfer position. The continuation of the rescue operation will therefore be described in connection with passengers in vessel 82'. It will be noted that in order to secure vessel 82' to rescue cabin 50, its hook member 86' was brought into engagement with connecting bar 94' by sufficiently lifting such vessel prior to its reaching the upper transfer position shown. Consequently, a safe transfer of the passengers from the rescue vessel 82' to the rescue cabin 50 via platform 61' is now possible, again with the assistance of a rescue team member if required.

Once the passengers have reached cabin 50, the corresponding rescue vessel may again be lowered to cabin 26 in order to continue with the rescue operation until all of the passengers are evacuated therefrom and transferred to the rescue car 46. For transporting the passengers to one of the stations or alternatively to a suitable tower it may be necessary to make car 46 ready for movement along rescue track 32. By bringing the platforms 61, 61' and support elements 62 to respective inclined and retracted positions, the passage of the rescue car through the yoke structure of a tower under certain wind conditions is greatly facilitated. In order for the passengers to leave the rescue cabin 50, one or both of the platforms 61, 61' will again be lowered to the horizontal position and the corresponding rescue vessel moved aside so as to allow unhindered passage over the platform.

Thus, it will be seen that the invention provides means in the form of the rescue unit 60 to bridge the vertical and horizontal gaps c and d and to allow transfer of passengers between the transport cars and the rescue car despite the spacing between their tracks. It will further be seen that the passengers of all or some of the transport cars of both tracks 18 and 20 may be rescued by the same rescue car 46. It should be noted that a plurality of rescue cars operating on the same track 32 is equally possible and may help to speed up a rescue operation for an installation of having a relatively large number of transport cars and a relatively great track length. A plurality of rescue cars may equally be employed if designed to operate in different sections or spans of the installation and it is feasible to place winches for respective haulage ropes 44 and prime movers therefor at conveniently placed towers 2. In this event, each such tower will be equipped with a staircase or other means permitting a convenient descent of passengers to the ground. Apart from the advantages of the track of the rescue system running above the tracks of the tramway or transport system for a safe rescue operation, such relative arrangement of the tracks safely avoids any interference of parts of one system, i.e. parts of the tramway system proper, with parts of the other, i.e. parts of the rescue system, such as under the influence of wind forces. Moreover, such arrangement facilitates the rescue system to be added to an existing tramway system and in particular the towers need not to be replaced, since the rescue structure may be mounted thereon.

In an alternative rescue car, not illustrated, a pulley corresponding to pulley 64 may be placed at the free end of an arm having its other end mounted at roof 76 so as to permit pivoting movement of such arm about a vertical and/or a horizontal axis. This will permit to bridge gap d, i.e. to place the rescue vessel close to side wall 27 or close to the respective side of cabin 50 and a platform 61 is not required. The same result may be obtained by providing an outwardly extending rail structure at roof 76 and a trolley supporting rope 80 guided for movement along this rail structure to bridge gap d.

According to a further alternative, instead of two rescue units being provided at the rescue car, a single rescue unit may suffice and, if rescue operations on two transport tracks are to be made possible, a single arm of such rescue unit, pivotable as mentioned above, or a rail structure pivotable about a vertical axis only may have its vertical pivot axis arranged so as to permit the arm to be traversed about an angle of at least 180°, so as to allow the rescue vessel to be operated on either side of the cabin 50. In an alternative rescue system the rescue cabin may be connected to the carriage of the rescue car for pivoting movement about a vertical axis passing through or near its center of gravity and thus permit to be traversed together with a single rescue unit attached to one side thereof from a transport position to rescue positions facing one or the other of two adjacent transport tracks. The rescue unit may of the type described in connection with the embodiment of FIGS. 1–4, i.e. identical with or similar to a rescue unit 60. However, instead of platforms partly or substantially bridging gap d or a pivotable arm the rail structure and trolley mentioned above may be provided and rigidly connected to roof.

In the foregoing the invention is described in connection with a gondola lift type installation in which the cabins take more than twenty passengers and where in view of load considerations two track cables are provided for the transport tracks as well as the rescue track. The invention may of course be used where smaller cars or cabins are provided and where only one track cable is provided or where there is a single cable or rope only for supporting and transporting the passenger cabins. Moreover, it is possible to employ the invention in connection with single or double reversible aerial tramways.

The foregoing description and drawing merely explain and illustrate the invention and it should be understood that various modifications may be restored to without departing from the scope of the invention disclosed and claimed herein.

What I claim is:

1. An aerial tramway installation comprising:

two spaced apart terminals;

a transport track interconnecting said terminals;

a rescue track extending along said transport track and elevated with respect thereto;

transport cars having transport cabins movable along said transport track and;

a rescue car having a rescue cabin movable along said rescue track, a rescue vessel and means for lowering and lifting said rescue vessel between said rescue cabin and a transport car on said transport track.

2. An aerial transport installation according to claim 1, wherein:

each of said transport track and said rescue track has at least one cable and wherein means are provided to support the cable of said rescue track above the cable of said transport track.

3. An aerial transport installation according to claim 2, wherein:

said support means include a tower intermediate said terminals.

4. An aerial transport installation according to claim 1, wherein:

two parallel transport tracks interconnect said terminals and said rescue track is coextensive therewith and arranged between said transport tracks, each track of said rescue track and said transport tracks has at least one cable, a tower is arranged intermediate said terminals supporting said cable of said rescue track above said cables of said transport tracks, and a plurality of transport cars is supported at each of said cables of said transport tracks.

5. An aerial tramway installation according to claim 4, wherein:

each of said transport tracks and said rescue track has a pair of track cables for supporting the transport cabins and the rescue cabin, respectively.

6. An aerial tramway installation as claimed in claim 5, wherein:

said rescue cabin is provided with a rescue vessel which is a basket-type container providing standing space for two persons.

7. An aerial transport installation as claimed in claim 4, wherein:

said transport tracks and said rescue track define a longitudinal direction, said rescue cabin on said rescue track and each of said transport cabins on a respective transport track having two side walls extending substantially in said longitudinal direction, each of said transport cabins having an inner side wall directed toward said rescue track and a respective of said side walls of said rescue cabin being directed toward a respective one of said transport tracks, said inner side walls of said transport cabins of a respective one of said transport tracks being outwardly spaced in a horizontal direction with respect to said respective side wall of said rescue cabin and wherein a vertical lowering and lifting path of said rescue vessel extends intermediate said respective side wall of said rescue cabin and said inner side walls.

8. An aerial transport installation as claimed in claim 7, wherein:

said side walls of said rescue cabin and said inner side walls of said transport cabins each has a door opening closed by a movable door element.

9. An aerial transport installation as claimed in claim 8, wherein:

a platform pivotable between a transport position and a rescue position is provided at each of said side walls of said rescue cabin and wherein a winch and a rescue vessel are associated with said platform.

10. An aerial transport installation as claimed in claim 7, wherein:

means are provided at said rescue vessel for alternative securing thereof at said transport car and at said rescue car.

11. An aerial transport installation as claimed in claim 7, wherein:

said tower includes cross beam means supporting said cables of said transport track and an additional rescue structure is mounted on top of said cross beam means supporting said cable of said rescue track.

12. An aerial transport installation as claimed in claim 11, wherein:

said rescue track and each of said transport tracks includes two track cables and wherein a traction cable is arranged intermediate said track cables of each track and wherein said rescue cabin is larger than each of said transport cabins.

13. An aerial tramway comprising:

a pair of parallel transport tracks; transport cars having passenger cabins and movable on said transport tracks;

a rescue track extending along said transport tracks in transversely and upwardly spaced relation;

a rescue car having a rescue cabin and movable along said rescue track and a rescue unit associated with said rescue car including a rescue vessel movable between a respective one of said transport cars and said rescue car, to thereby permit a transfer of passengers between a passenger cabin and said rescue cabin.

14. An aerial tramway as claimed in claim 13, wherein:

said rescue track extends intermediate said transport tracks, and wherein said rescue cabin includes door means and said rescue vessel is movable horizontally and vertically between said door means of said rescue cabin and a respective one of said passenger cabins.

15. An aerial tramway as claimed in claim 14, wherein:

said rescue unit includes winch means connecting to said rescue vessel with said rescue cabin.

16. An aerial tramway as claimed in claim 15, wherein:

a rescue unit is provided for each of said transport tracks and said rescue car includes door means opposite each of said transport tracks.

17. An aerial tramway as claimed in claim 16, wherein:

each of said door means includes a door opening and each of said rescue units includes a platform and rescue vessel guide means arranged in front of a respective door opening.

* * * * *